US006577071B2

(12) United States Patent
Matsumoto

(10) Patent No.: US 6,577,071 B2
(45) Date of Patent: Jun. 10, 2003

(54) DATA DRIVER CIRCUIT FOR A PLASMA DISPLAY DEVICE

(75) Inventor: Kazuhisa Matsumoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/106,217

(22) Filed: Mar. 27, 2002

(65) Prior Publication Data

US 2002/0140367 A1 Oct. 3, 2002

(30) Foreign Application Priority Data

Mar. 28, 2001 (JP) ..... 2001-093470

(51) Int. Cl.[7] ..... G09G 3/10; G09G 3/28

(52) U.S. Cl. ..... 315/169.4; 345/60; 315/169.1

(58) Field of Search ..... 315/169.4, 169.1; 345/60, 213, 63, 67, 98, 100, 94, 95, 89

(56) References Cited

U.S. PATENT DOCUMENTS 5,764,212 A * 6/1998 Nishitani et al. ..... 345/98
6,340,960 B1 * 1/2002 Song et al. ..... 345/60
2001/0024179 A1 * 9/2001 Nakamura ..... 345/60
2002/0145602 A1 * 10/2002 Matsueda ..... 345/213

FOREIGN PATENT DOCUMENTS

| | | | |
|---|---|---|---|
| JP | 5-232900 | A | 9/1993 |
| JP | 7-248744 | A | 9/1995 |
| JP | 10-3280 | A | 1/1998 |
| JP | 2000-330508 | A | 11/2000 |
| JP | 2000-338932 | A | 12/2000 |

* cited by examiner

*Primary Examiner*—Don Wong
*Assistant Examiner*—Chuc D Tran
(74) *Attorney, Agent, or Firm*—Sughrue Mion, PLLC

(57) ABSTRACT

In a data driver circuit for a plasma display device having a first data electrode and a second electrode that are disposed adjacently each other, the data driver circuit having: a first circuit means for outputting first display data to the first data electrode; a second circuit means for outputting second display data to the second data electrode; and an output timing control means for controlling a timing of outputting the first display data from the first circuit means to the first data electrode or a timing of outputting the second display data from the second circuit means to the second data electrode.

8 Claims, 14 Drawing Sheets

DATA DRIVER CIRCUIT FOR A PLASMA DISPLAY DEVICE

BACKGROUND OF THE INVENTION

1. Field of the Invention

The present invention relates to a drive circuit of a plasma display device, and more particularly to a data driver having a function that reduces noise attributed to display data, generated at the time of electrode voltage switching.

2. Related Art

In a plasma display of the surface discharge type, row and column electrodes are provided on two glass substrates, respectively, a dielectric layer being provided above the row electrodes of the row electrode glass substrate and a phosphor layer being provided over the column electrodes of the column electrode glass substrate having partition walls, a discharge space being provided between two substrates facing each other and a gas being sealed between the above-mentioned two substrates, which form display panel having a planar matrix structure, in which the row electrodes and the column electrodes are independently driven, so as to cause a plasma discharge at the intersection (cell) between driven row and column electrodes, thereby exiting the phosphor layer provided on the column electrodes so that it emits light. In the case of a display panel that produces a color display, each column electrode is made up of electrodes for three colors having phosphor layer for red (R), green (G), and blue (B), each of the color electrodes for each column being driven separately so as to produce a color display having a plurality of colors.

Additionally, as the row electrodes, X electrodes and electrodes are provided. The X electrodes provided in common for each row and the Y electrodes provided for each row are alternately disposed. In the above-noted case, when driving these electrodes, a voltage pulse is applied alternating between the X and Y electrodes, thereby causing a discharge that reverses the electrode each half cycle. This type of driving method is known as AC drive method.

In an AC plasma display panel (AC-PDP) as described above, once a discharge occurs between the electrodes of each cell, the electrons and ions generated in the discharge space are accumulated on the phosphor layer, thereby forming a wall charge, after the formation of which it is possible because of the action of the wall charge to cause a discharge with a low voltage, and it is possible to sustain the discharge by alternating this low voltage each half cycle. This function is called as a memory function, the discharge sustained by the low voltage based on the memory function is called as sustaining charge.

In an AC-PDP, in order to achieve a gradation representation, the video signal during a single field period is divided into a plurality of sub-fields, the time (number of times) during which a discharge is sustained for each sub-field being controlled. More specifically, for each sub-field, after resetting, by assigning a sustaining discharge period that increases in proportion to $2^n$, for example, the greater is the number of sustaining discharges made, the brighter will be the light from a cell, thereby performing a gradation representation.

The configurations of an AC-PDP and a conventional data driver circuit and the operation thereof are described below.

FIG. 9 of the accompanying drawings, is a block diagram showing the configuration of an AC color PDP to which the prior art and the present invention could be applied, FIG. 10 is a drawing showing the configuration of a data driver circuit of the past, FIG. 11 is a timing diagram showing the format of the display data input to the data driver circuit, and FIG. 12 is a flowchart illustrating the output operation of the data driver circuit.

As shown in FIG. 9, an AC-PDP 100 has a plurality of data driver circuits 101A, 101B, 101C, . . . , 101E, an AC type plasma display panel (AC-PDP) 102, scan driver circuits 103A, . . . , 103C, a format conversion circuit 104, a drive signal generating circuit 105, and a high-voltage drive circuit 106.

The data driver circuits 101A, 101B, 101C, . . . , 101E, which are formed by integrated circuits, receive from the format conversion circuit 104 a prescribed number (n) of serial display data signals at a time corresponding to the N column electrodes, and output data in parallel to the column electrodes for each scan period in response to a parallel latch control signal from the drive signal generating circuit 105.

The AC-PDP 102 is an AC-driven type plasma display panel, which performs drive in accordance with a sub-field sequence using a memory function, and has a matrix electrode arrangement having M rows of row electrodes and N columns of column electrodes (data electrodes) corresponding to the three colors R, G, and B for each of the columns. The scan driver circuits 103A, . . . , 103C, which are formed by integrated circuits, in response to row drive signals from the drive signal generating circuit 105 for each prescribed number of rows, sequentially output scan signals to the M rows of row electrodes.

The format conversion circuit 104 converts the format of video data having the three colors R, B, and G by using frame memories 111, and the converted three colors R, G, and B signals are sequentially arranged for each column, and the serial display data signals are output from the format conversion circuit 104.

The drive signal generating circuit 105, in response to a vertical synchronization signal included in the video data signal detected by a vertical synchronization signal detection circuit (not shown in the drawing), according to a prescribed sequence for each field, generates row and column drive signals, and supplies these signals to the data driver circuits 101A, 101B, 101C, . . . , 103E, and to the scan driver circuits 103A, . . . , 103C. The high-voltage drive circuit 106, in response to a drive signal from the drive signal generating circuit 105, supplies a high-voltage to each of the data driver circuits 101A, 101B, 101C, . . . , 101E.

A data driver circuit 101 of the past, as shown in FIG. 10, generally comprises an n-stage shift register circuit 11, a parallel latch circuit 12 with n circuits, n output control logic gates G1, G2, G3, G4, . . . , Gn, and n high withstand voltage CMOS (complementary metal oxide semiconductor) drivers B1, B2, B3, B4, . . . , Bn. In the AC-PDP 102 as shown in FIG. 10, the electrode structure for each of the three colors R, G, and B in each column is abbreviated to just a single data electrode DL that is shown.

The shift register circuit 11 is formed by an n-stage shift register, and acts to shift the serial display data signal DS input from the frame memory 111 for each scan period at a time. The parallel latch circuit 12 latches the outputs from the n-stage shift register of the shift register circuit 11 in response to a parallel latch control signal Φ from the drive signal generating circuit 105.

The output control gate circuits G1, G2, G3, G4, . . . , Gn, in response to an output control signal OS from the drive signal generating circuit 105, output signals Q1, Q2, Q3, Q4, . . . , Qn from the parallel latch circuit 12 for each scan period. The high-voltage CMOS drivers B1, B2, B3, B4, . . . , Bn, by using the high-voltage supply Vd from the high-voltage drive circuit 106, convert the parallel signals Q1, Q2, Q3, Q4, . . . , Qn from the output control gate circuits G1, G2, G3, G4, . . . , Gn to data signals O1, O2, O3, O4, . . . , On, which are high-voltage write pulses, these being output to the data electrodes of the AC-PDP 102.

The output states of the data driver circuit 111, as shown in FIG. 11, have two forms. In FIG. 11, FIG. 11(*a*) shows the case of 1-bit data output, and FIG. 11(*b*) shows the case of 3-bit data output.

In the case of 1-bit data output, as shown in FIG. 11(*a*), the input data DS are repeatedly arranged in the sequence of R, G, and B, the shift register circuit 11 shifts these data DS at each rising edge of the shift clock, and when the final shift is reached, at the falling edge, for example, of the parallel latch control signal the data are latched into the parallel latch circuit 12, output being made therefrom one bit at a time, for example as the serial display data signal sequence On, On-1, On-2, On-3, On-4, On-5, On-6, . . . , O3, O2, O1.

In the case of 3-bit data output, as shown in FIG. 11(*b*), although input data DS are same data as FIG. 11(*a*), R, G, and B input data are grouped by 3 bits at a time in the sequence of R, G, and B, then the shift register circuit 11 shifts R, G, and B at a rising edge of the shift clock signal SC. When the shift register circuit 11 shifts the last input data, the shifted data by the shift register circuit 11 is latched by the parallel latch circuit 12 at the falling edge of the parallel latch control signal Φ. The serial display data signal 1, the serial display data signal 2, and the serial display data 3 are grouped into one group, and output by 3 bits at a time in the sequence (On, On-1, On-2), (On-3, On-4, On-5), (On-6, On-7, On-8) . . . , (O3, O2, O1).

The operation of an AC-PDP device of the past is described below, with references to FIG. 9 through FIG. 12.

An AC-PDP has a configuration such as shown in FIG. 9, in which a video data signal serially input to the format conversion circuit 104 for each of the colors R, G, and B is divided in accordance with number of data outputs from the data driver circuit 101, and converted data are transferred serially to each data driver circuit 101A, 101B, 101C, . . . , 101E during the scan period by using separate signal lines.

At each of the data driver circuits, the serial display data signal DS for each color that was transferred in serial fashion, in response to the shift clock signal SC, is arranged in an R, G, and B sequence and input to the shift register circuit 11, the output from the shift register circuit 11 being latched by the parallel latch circuit 12 in accordance with the parallel latch control signal Φ. Parallel output signals are generated in the output control logic gate circuits G1, G2, G3, G4, . . . , Gn, in response to the output control signal OS. These parallel output signals are input to the high-voltage CMOS driver B1, B2, B3, 4, . . . , Bn at the same time so as to generate the high-voltage write pulse data signals O1, O2, O3, O4, . . . , On, then these high-voltage write pulse data signals are output to each of the data electrodes of the AC-PDP 102.

In this case, at each of the data driver circuits, as shown in FIG. 12, in response to the rising edge of the output control signal OS, by inputting the parallel input signal Q to the high-voltage CMOS driver B via the output control logic gate circuit G, conversion is made of the high level of the parallel input signal Q to the high power supply voltage Vd, and conversion is made of the low level to 0 V for output, so that, in response to the parallel input signal Q, the high power supply voltage Vd is applied to the data electrode, thereby causing a discharge at a cell at an intersection with a row electrode that is being scanned.

In a AC-PDP of the past, when data is written to the data electrodes during sub-fields from the data driver circuit, between a given sub-field and a sub-field therebefore or thereafter if the data changes from the condition in which all the data signals are "on" state to the condition in which all the data signals are "off" state, or if the levels of all the data signals change in the reverse direction from the above, there is the problem of noise occurring at the data electrodes of the AC-PDP when switching occurs of the high-voltage of the data signals.

FIG. 13 is a timing diagram illustrating the noise occurring in a data driver circuit of the past and FIG. 14 is a timing diagram illustrating noise occurring in a data driver circuit of the past.

FIG. 13 shows the case in which adjacent outputs are switched to be the same potential, in which case when the parallel input signals Q1, Q2, and Q3 corresponding to the three adjacent data electrodes drive the high-voltage CMOS drivers G1, G2, and G3, so as to drive the high-voltage CMOS drivers B1, B2, and B3, the high power supply voltage Vd being switched so as to convert it to the data signals O1, O2, and O, the voltages at each of the data electrode are relatively the same, and because it is not possible to achieve a discharge load by means of the inter-electrode capacitances C1 and C2 between adjacent electrodes, a sudden change in voltage occurs, thereby causing the large switching noise indicated by the arrows at the rising edge and falling edge of each of the data signals.

In FIG. 14, which shows the case in which there is switching of adjacent outputs that are mutually differing potential at the same time, similar to the case shown in FIG. 13, the parallel input signals Q1, Q2, and Q3 corresponding to three adjacent data electrodes cause switching of the high-voltage supply voltage Vd at the respective high withstand voltage CMOS drivers B1, B2, and B3, so as to convert it to the data signals O1, O2, and O, the voltages at each of the data electrodes being relatively increased, resulting in switching noise at the rising edge and falling edge of each data signal being suppressed. In this case, because it is possible to achieve a discharge load by means of the inter-electrode capacitances C1 and C2 between adjacent electrodes.

In an AC-PDP, depending upon the spatial and temporal arrangement of the display data, there are cases in which the changes that will be a same potential at the same time on adjacent data electrodes occur, in which case, as shown in FIG. 13, charging and discharging of the electrostatic charge between the electrodes do not occur, so that there is a sudden rise in the voltage waveform and the switching currents of the adjacent data electrodes flow in the same direction, resulting in a large amount of noise occurring.

This noise causes a change in the ground level, and this noise becomes an interference noise to the display data. Such interference can manifest itself as dot or line noise on the display screen that is not existent in the original video signal, or noise propagating on the power line increases, or an EMI (electromagnetic interference) increases.

Accordingly, the present invention was made in consideration of the above-noted situation, and has as an object to provide a data driver circuit which, in an AC-PDP or the like, by reducing the opportunity for a change that becomes the same potential at the same time on adjacent data electrodes to occur, achieves a charging/discharging load between adjacent data electrodes at the time of switching of high-voltage data on a data electrode based on a change in the display data, thereby suppressing a sudden change in the switching voltage waveform and reducing the occurrence of noise.

SUMMARY OF THE INVENTION

To achieve the above-noted object, the present invention has the following basic technical constitution.

The first aspect of the present invention is a data driver circuit for a plasma display device having a first data electrode and a second electrode that are disposed adjacently to each other, the data driver circuit comprising: a first circuit means for outputting first display data to the first data electrode; a second circuit means for outputting second display data to the second data electrode; and an output timing control means for controlling a timing of outputting the first display data from the first circuit means to the first data electrode or a timing of outputting the second display data from the second circuit means to the second data electrode.

The second aspect of the present invention is a data driver circuit for a plasma display device having a first data electrode and a second electrode that are disposed adjacently to each other, the data driver circuit comprising: a first latch circuit for latching first display data for outputting to the first data electrode; a second latch circuit for latching second display data for outputting to the second data electrode; a first latch signal for the first latch circuit; a second latch signal for the second latch circuit; and a latch timing control means for controlling a latch timing of the first display data by the first latch signal or a latch timing of the second display data by the second latch signal; wherein the latch timing of the second latch circuit is different from that of the first latch circuit.

In the third aspect of the present invention, the data driver circuit further comprising: a time difference generating means for controlling the latch timing control means in accordance with the first display data and the second display data; wherein the time difference generating means generates a time difference between the latch timing of the first latch circuit and the latch timing of the second latch circuit.

The fourth aspect of the present invention is a data driver circuit for a plasma display device having a first data electrode and a second electrode that are disposed adjacently to each other, the data driver circuit comprising: a first circuit means for outputting first display data to the first data electrode at a first timing; a second circuit means for outputting second display data to the second data electrode at the first timing or a second timing that is different from the first timing; and an output timing control means for selecting either the first timing or the second timing so as to control an output timing of the second circuit means.

The fifth aspect of the present invention is a data driver circuit for a plasma display device having a first data electrode and a second electrode that are disposed adjacently to each other, the data driver circuit comprising: a first latch circuit for latching first display data for outputting to the first data electrode; a second latch circuit for latching second display data for outputting to the second data electrode; a latch signal for the second latch circuit; and a latch timing control means for controlling a latch timing of the second display data by the latch signal; wherein the latch timing of the second latch circuit is different from that of the first latch circuit.

The sixth aspect of the present invention is a data driver circuit for a plasma display device having a first data electrode and a second electrode that are disposed adjacently to each other, the data driver circuit comprising: a first latch circuit for latching first display data for outputting to the first data electrode; a second latch circuit for latching second display data for outputting to the second data electrode; a first latch signal for the first latch circuit; and a second latch signal, a latch timing of which being different from that of the first latch circuit, for the second latch circuit.

The seventh aspect of the present invention is a data driver circuit for a plasma display device having a first data electrode and a second electrode that are disposed adjacently to each other, the data driver circuit comprising: a first circuit means for outputting first display data to the first data electrode; a second circuit means for outputting second display data to the second data electrode; and a delay means provided in the second circuit means so as to delay an output timing of the second display data with respect to that of the first display data.

BRIEF DESCRIPTIONS OF THE DRAWINGS

Figure 11A:
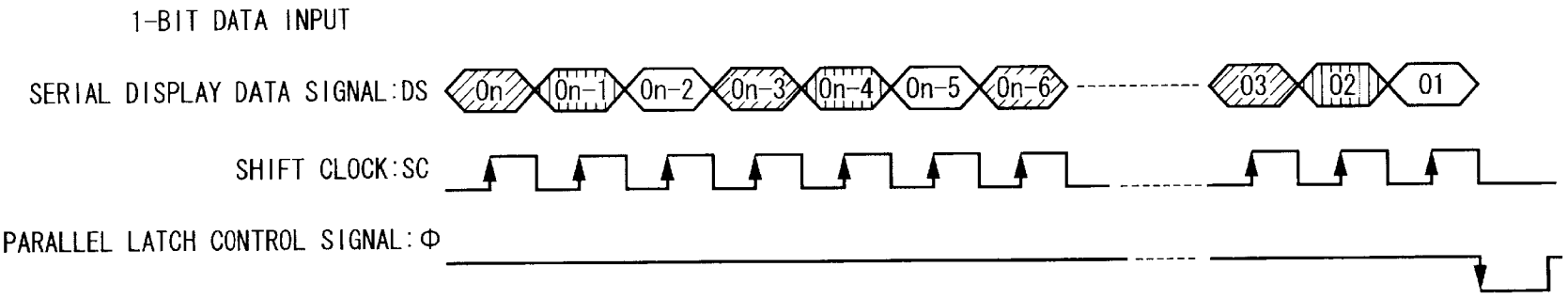
FIG. 11(a) PRIOR ART
Figure 11B:
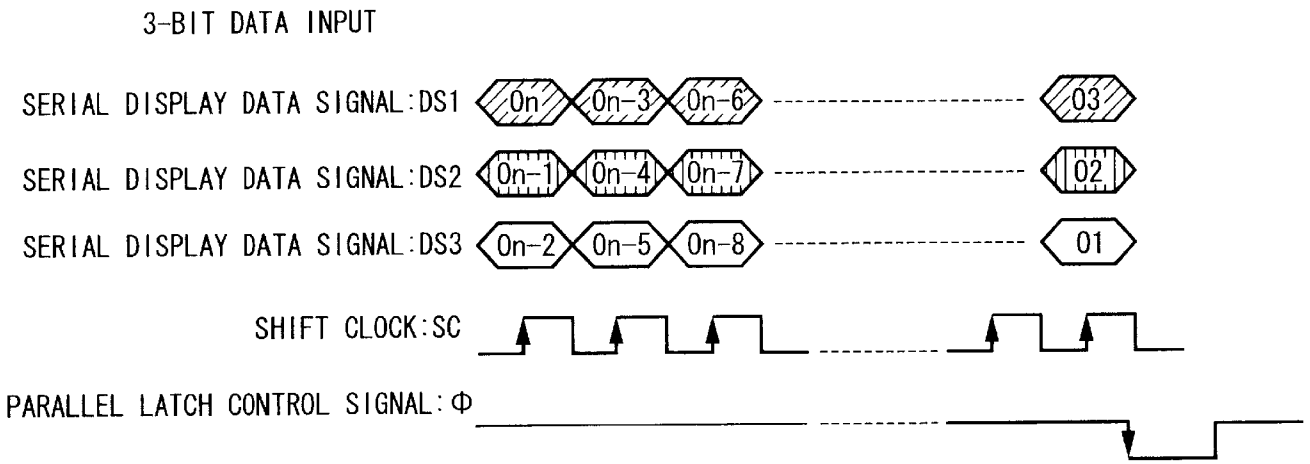
FIG. 11(b) PRIOR ART

FIGS. 11(*a*) and 11(*b*) are timing diagrams showing the display data input format of the data driver format.

Figure 12:
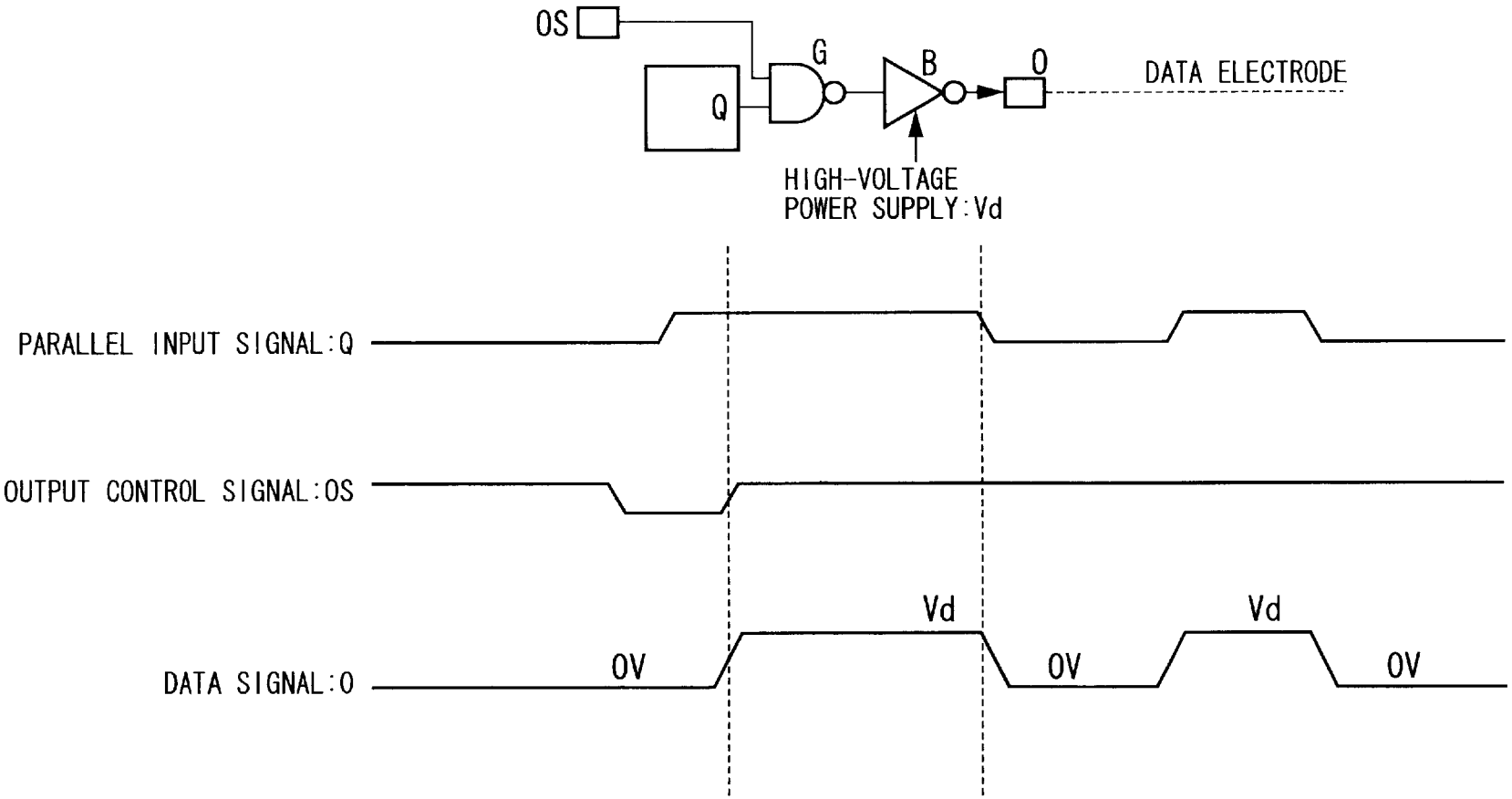
FIG. 12 PRIOR ART

FIG. 12 is a timing diagram illustrating the output operation of a data driver circuit.

Figure 13:
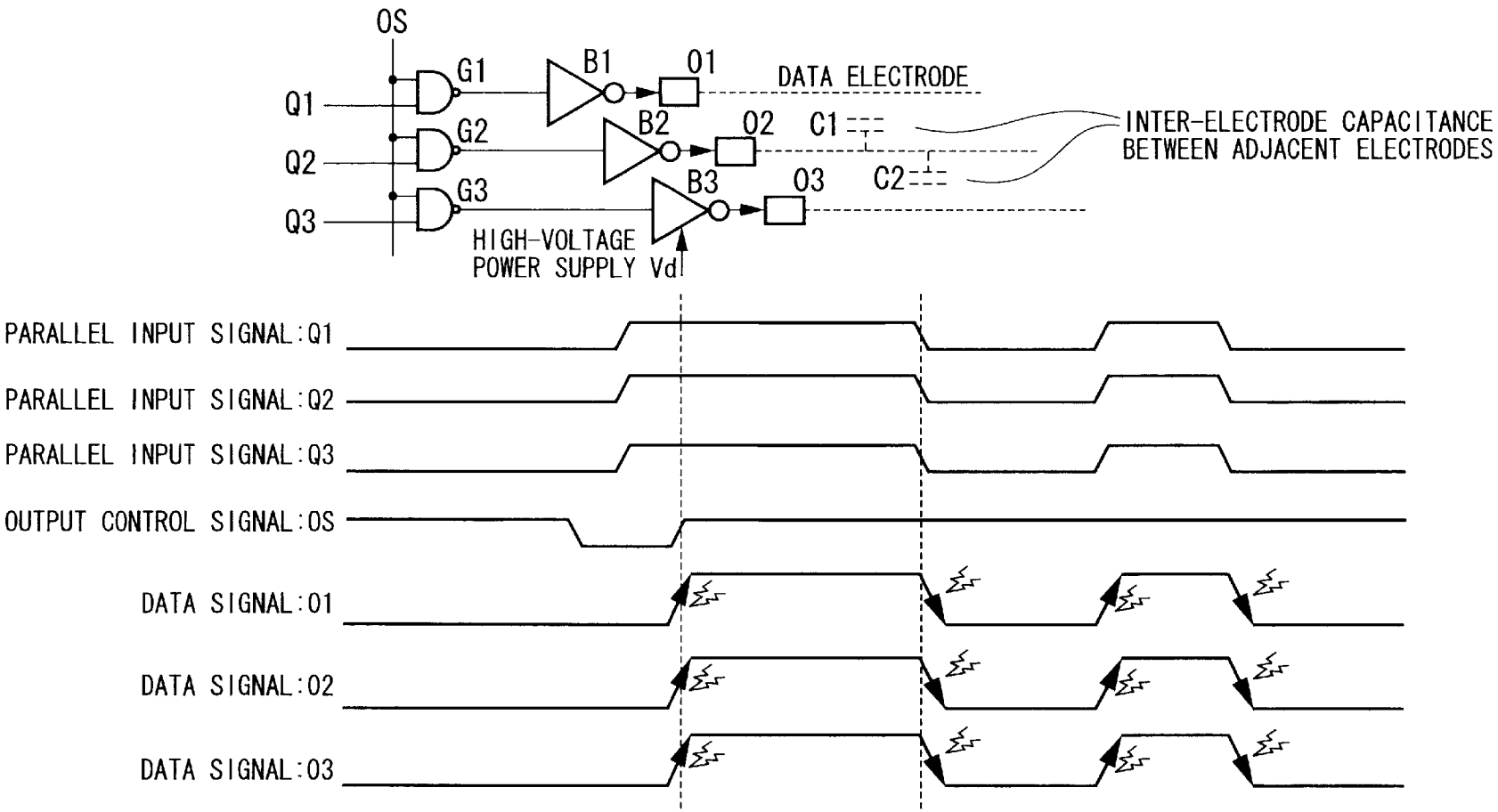
FIG. 13 PRIOR ART

FIG. 13 is a timing diagram illustrating the generation of switching noise in the conventional data driver circuit.

Figure 14:
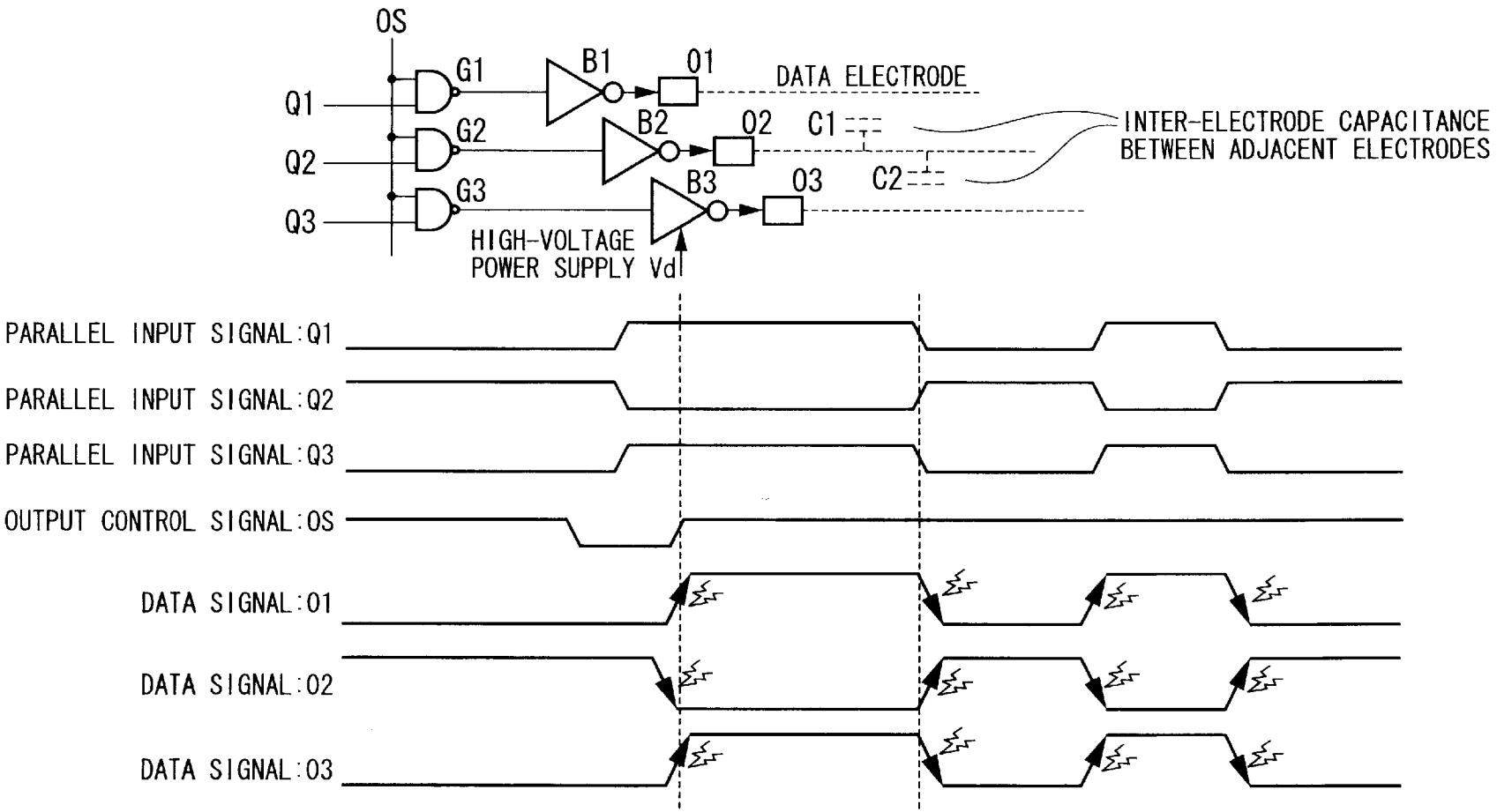
FIG. 14 PRIOR ART

FIG. 14 is another timing diagram illustrating the generation of switching noise in the conventional data driver circuit.

DETAILED DESCRIPTION OF THE PREFERRED EMBODIMENTS

Embodiments of the present invention are described in detail below, with reference made to relevant accompanying drawings.

(First Embodiment)

Figure 1:
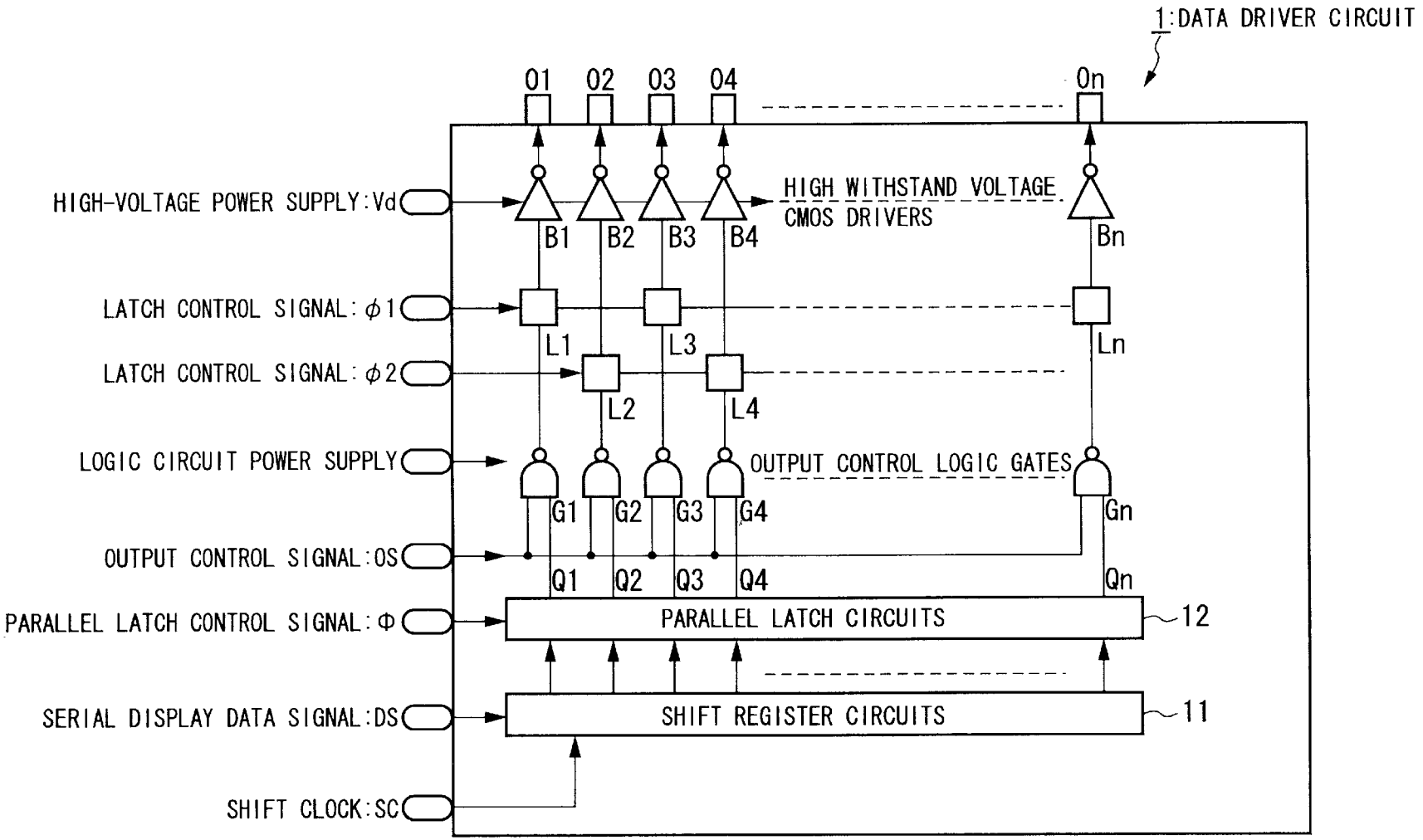
FIG. 1 is a drawing showing the configuration of a data driver circuit according to a first embodiment of the present invention.
Figure 2:
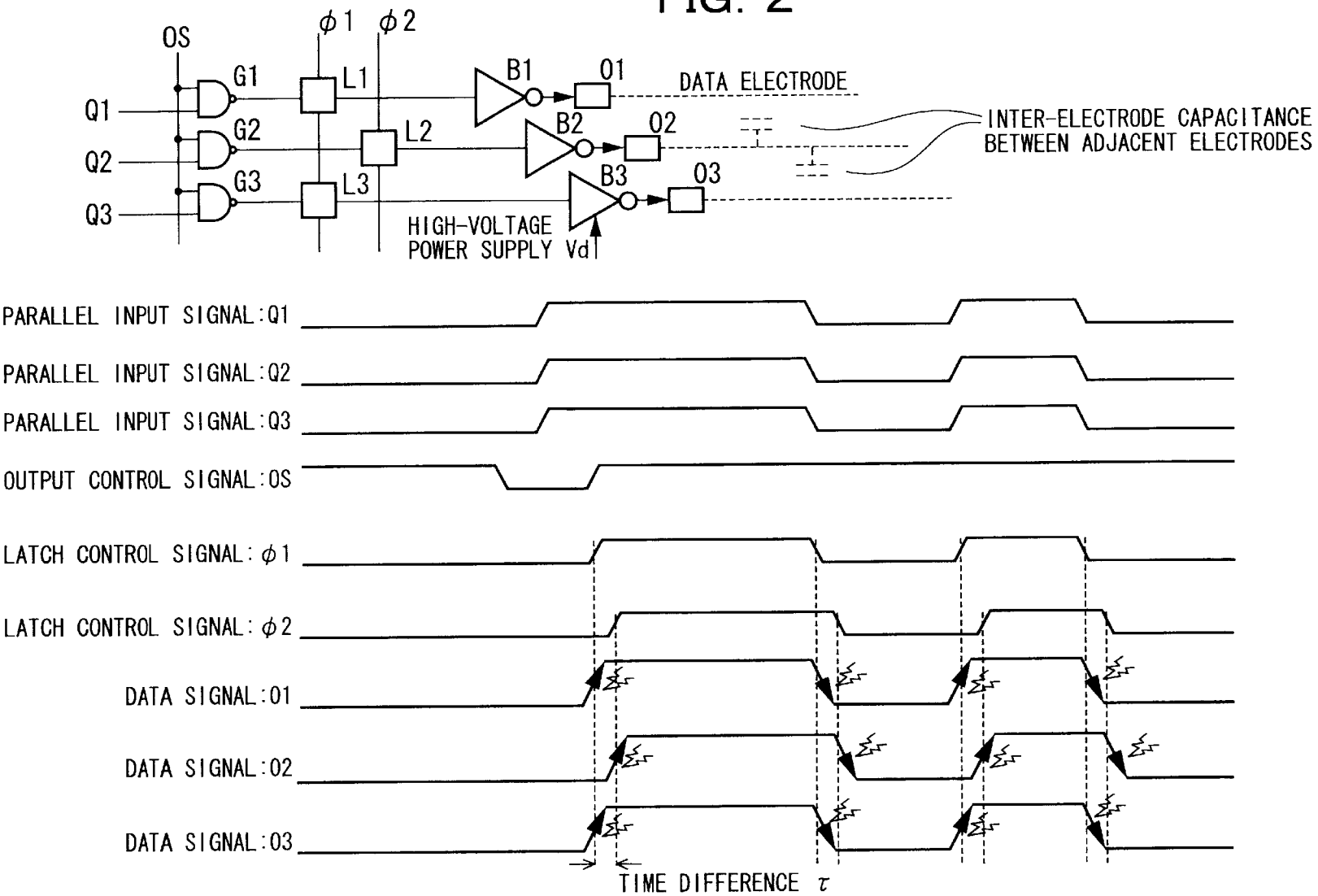
FIG. 2 is a timing diagram illustrating the generation of switching noise in the first embodiment of the present invention.
Figure 3:
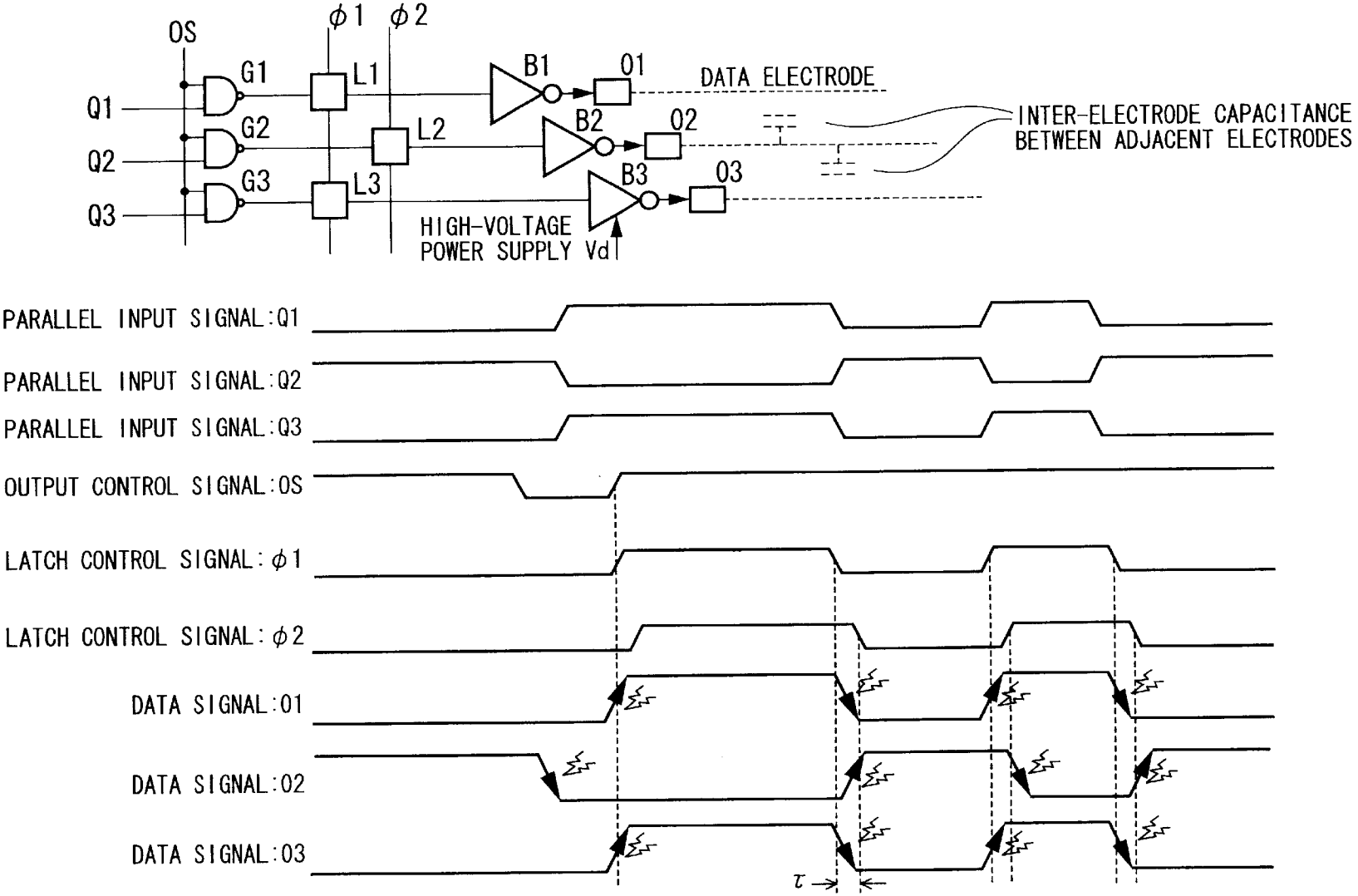
FIG. 3 is another timing diagram illustrating the generation of switching noise in the first embodiment of the present invention.

FIG. 1 is a drawing showing the configuration of a data driver circuit according to a first embodiment of the present invention, FIGS. 2 and 3 are timing diagrams illustrating the generation of noise in the first embodiment of the present invention.

The data driver circuit 1 of the present invention, as shown in FIG. 1, is generally formed by an n-stage shift register circuit 11, n parallel latch circuits 12, n output control logic gate circuits G1, G2, G3, G4, . . . , and Gn, n latch circuits L1, L2, L3, L4, . . . , and Ln formed by D-type flip-flops or the like, and n high withstand voltage CMOS drivers B1, B2, B3, B4, . . . , and Bn.

Figure 9:
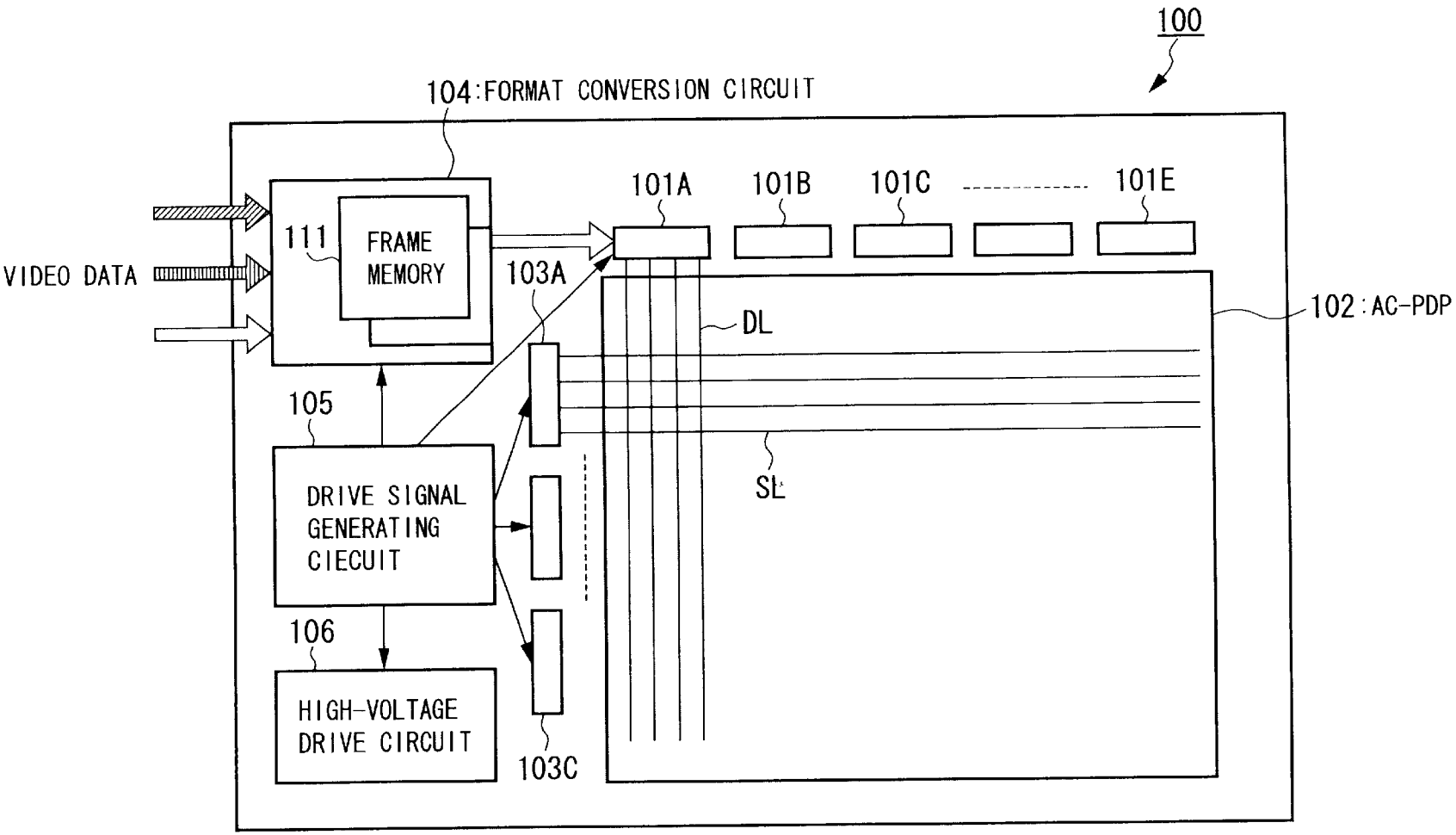
FIG. 9 PRIOR ART
FIG. 9 is a block diagram showing the configuration of a color AC-PDP device to which the prior art and the present invention are applied.
Figure 10:
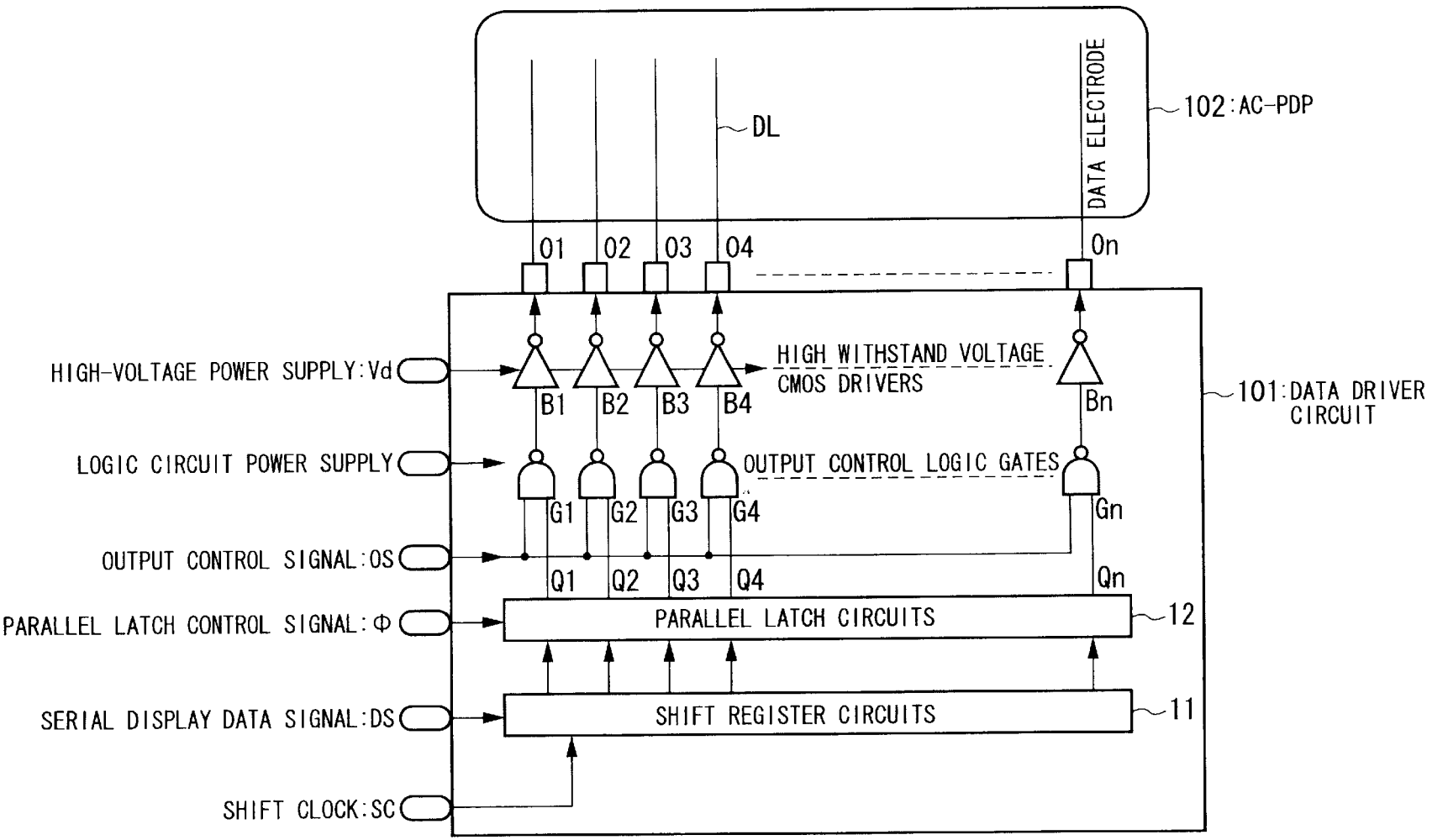
FIG. 10 PRIOR ART
FIG. 10 is a drawing showing the configuration of a conventional data driver circuit.

Of the above-noted elements, because the shift register circuit 11, the parallel latch circuits 12, the output control logic gate circuits G1, G2, G3, G4, . . . , and Gn, and the high withstand voltage CMOS drivers B1, B2, B3, B4, . . . , Bn are similar to the case of the prior art, shown in FIG. 9, they will not be described in detail herein.

Of the latch circuits L1, L2, L3, L4, . . . , and Ln, the odd-numbered latch circuits L1, L3, and so on, latch output signals from the respective odd-numbered output control 3 logic gate circuits G1, G3, and so on, in response to an applied external latch control signal Φ1, these being input to the high withstand voltage CMOS drivers B1, B3, and so on, so that the high withstand voltage CMOS drivers B1, B3 and so on switch the high supply voltage Vd and output the data signals O1, O3, and so on. Similarly, the even-numbered latch circuits L2, L4, and so on, latch output signals from the respective even-numbered output control logic gate circuits G2, G4, and so on, in response to an applied external latch control signal Φ2, these being input to the high withstand voltage CMOS drivers B2, B4, and so on, so that the high withstand voltage CMOS drivers B2, B4 and so on switch the high supply voltage Vd and output the data signals O2, O4, and so on.

The operation of the data driver circuit of the first embodiment is described below, with references made to FIG. 1, FIG. 2, and FIG. 3.

A serial display data signal DS input to the data driver circuit 1 from a format conversion circuit 104 is input to the shift register circuit 11 for each scan period in response to a shift clock signal SC from the drive signal generating circuit 105, the output from the shift register circuit 11 being latched by the parallel latch circuits 12 in response to a parallel latch control signal Φ from the drive signal generating circuit 105. The output control logic gate circuits G1, G2, G3, G4, . . . , and Gn output the parallel input signals Q1, Q2, Q3, Q4, . . . , and Qn from the parallel latch circuits 12 in parallel in response to the output control signal OS from the drive signal generating circuit 105.

Of the latch circuits L1, L2, L3, L4, . . . , Ln, the odd-numbered latch circuits L1, L3 and so on, in response to an externally applied latch control signal ϕ1 latch the respective output signals from the odd-numbered output control logic gate circuits G1, G3, and so on, and input them to the high withstand voltage CMOS drivers B1, B3, and so on so that the high withstand voltage CMOS drivers B1, B3, and so on switch the high power supply voltage Vd and output the data signals O1, O3, and so on. Similarly, the even-numbered latch circuits L2, L4 and so on, in response to an externally applied latch control signal ϕ2 latch the respective output signals from the even-numbered output control logic gate circuits G2, G4, and so on, and input them to the high withstand voltage CMOS drivers B2, B4, and so on so that the high withstand voltage CMOS drivers B2, B4, and so on switch the high power supply voltage Vd and output the data signals O2, O4, and so on.

When this occurs, a time difference τ is imparted between the externally applied latch control signals ϕ1 and Φ2 in the case in which an external circuit (not shown in the drawing) detects that a change that becomes the same potential at the same time on the data signals on adjacent electrodes occurs frequently during one scan period.

The phase of the output signals of the output control logic gate circuits G1, G2, G3, G4, . . . , and Gn, and those of parallel input signals Q1, Q2, Q3, Q4, . . . , and Qn, are same. However, the latch control signals ϕ2 rises with respect to latch control signals ϕ1 in a predetermined time τ. That is, the latch control signals ϕ2 delays with respect to latch control signals ϕ1. Therefore, the input signals of even-numbered high withstand voltage CMOS drivers B2, B4, . . . , delay with respect to those of the odd-numbered high withstand voltage CMOS drivers B1, B3, . . . , for a predetermined time τ, respectively. Accordingly, the even-numbered data signals O2, O4, . . . , delay with respect to those of the odd-numbered data signals O1, O3, . . . , for a predetermined time τ.

As constituting the above, for example, during the even-numbered data signals O2, O4, . . . , are outputting, the odd-numbered data signals O1, O3, . . . , do not output, so that it is possible to achieve a charging/discharging load by means of inter-electrode capacitances C1 and C2 between adjacent data electrodes at the time of switching of high-voltage data, thereby suppressing a sudden change in the switching voltage waveform and reducing the occurrence of noise.

In this case, even if achieving a charging/discharging load by means of inter-electrode capacitances, the time required for switching in the high withstand voltage CMOS drivers is generally approximately 3 nS to 14 ns, so that the time delay to be imparted to the latch control signal ϕ2 is only approximately 100 ns. Accordingly, it easy to impart the delay time τ between the latch control signals ϕ1 and ϕ2.

In FIG. 2, the adjacent output signals Q1, Q2, Q3 simultaneously change to be the same potential. However, there is a time difference T between the latch control signals Φ1 and ϕ2. Therefore, the even-numbered data signal O2 delays τ with respect to the odd-numbered data signals O1, O3. In this case, it is possible to achieve a charging/discharging load by means of inter-electrode capacitances C1 and C2 between adjacent data electrodes at the time of switching of high-voltage data, thereby suppressing a sudden change in the switching voltage waveform and reducing the occurrence of noise.

In FIG. 3, the adjacent output signals Q1, Q2, Q3 simultaneously change to be the different potential. However, there is a time difference τ between the latch control signals Φ1 and ϕ2. Therefore, the potentials of the odd-numbered data signals O1 and O3 and the even-numbered data signal O2 change to be the different potential, and further there is a time difference τ therebetween, so that, it is possible to achieve a charging/discharging load by means of inter-electrode capacitances C1 and C2 between adjacent data electrodes at the time of switching of high-voltage data, thereby suppressing a sudden change in the switching voltage waveform and reducing the occurrence of noise.

In general, there are two methods for imparting of a time difference between the odd-numbered data signals and the even-numbered data signals, one method being a method for imparting a time difference for all signals during one scan period, and the other method is a method in which imparting a time difference is performed when potentials of all or a majority of the data signals output from the data driver circuit change to be a same potential at the same time during one scan period.

Although the method in which a time difference is provided to all adjacent data electrodes during one scan period has the advantage of being able to implement it without the need for a complex circuit, because the imparting of a time difference to data signals at adjacent data electrodes applies restraints on the time required to establish the stability of the output to a data electrode, there is a danger that the there will not be enough time to write a high-voltage data to a data electrode, thereby causing an abnormality in light output condition. To prevent such problems, there are cases in which the operating speed of the AC-PDP itself be reduced.

Because the probability of noise being generated is great when potentials of data change to be the same potential with a high frequency, by detecting the frequency at which potentials of data change to be the same potential and imparting a time difference to the data signals between adjacent data electrodes, it is possible to prevent noise without affecting the performance of the AC-PDP itself. However, this requires a circuit to detect the frequency of data voltages changing to be the same potential, thereby making the configuration more complex.

Therefore, the externally applied latch control signals Φ1 and ϕ2 are determined in accordance with the purpose and function of the AC-PDP device.

According to a data driver circuit configured as described in this embodiment, because there is a time difference between odd-numbered high-voltage signals and even-numbered high-voltage signals in accordance with externally applied latch control signals ϕ1 and ϕ2, even if potentials of data changes to be the same potential at the same time, it is possible to achieve a charging/discharging load by means of the inter-electrode capacitance, thereby suppressing a sudden change in the voltage waveform when high-voltage data is switched at data electrodes, and reducing the accompanying switching noise.

(Second Embodiment)

Figure 4:
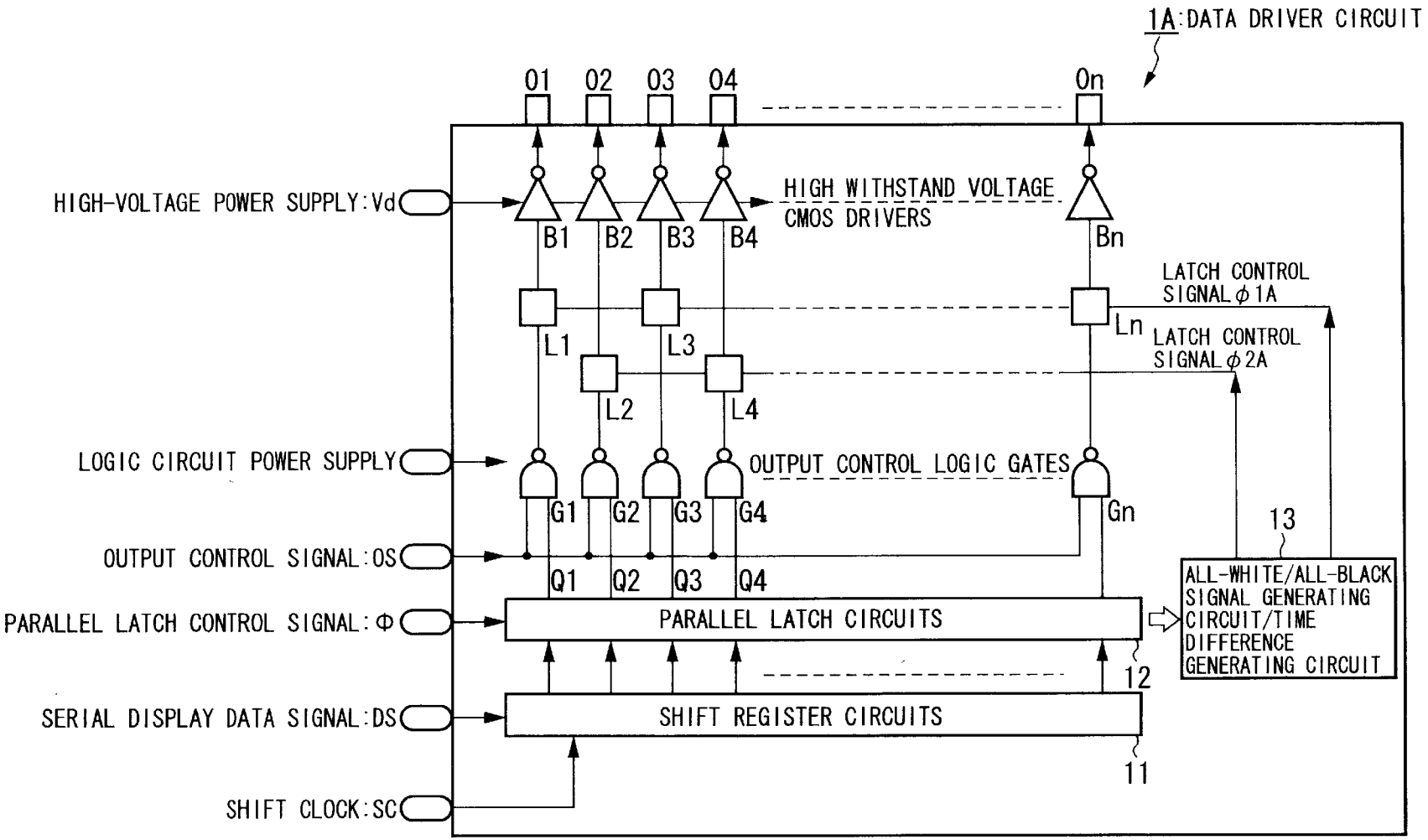
FIG. 4 is a drawing showing the configuration of a data driver circuit according to a second embodiment of the present invention.

FIG. 4 shows the configuration of a data driver circuit according to a second embodiment of the present invention.

As shown in FIG. 4, this data driver circuit 1A is generally formed by an n-stage shift register circuit 11, n parallel latch circuits 12, n output control logic gate circuits G1, G2, G3, G4, . . . , and Gn, n latch circuits L1, L2, L3, L4, . . . , and Ln, n high withstand voltage CMOS drivers B1, B2, B3, B4, . . . , and Bn, and an all-white/all-black signal generating circuit/time difference generating circuit 13.

Of the above-noted elements, because the shift register circuit 11, the parallel latch circuits 12, the output control logic gate circuits G1, G2, G3, G4, . . . , and Gn, and the high withstand voltage CMOS drivers B1, B2, B3, B4, . . . , Bn are similar to the case of the prior art, shown in FIG. 9, they will not be described in detail herein.

In this embodiment, the configuration and function of the latch circuits L1, L2, L3, L4, . . . , and Ln are similar to the first embodiment illustrated in FIG. 1, with the difference being that latch control signals ϕ1A and ϕ2A, rather than being applied from outside, are applied from an all-white/all-black signal generating circuit/time difference generating circuit 13 provided within the data driver circuit 1A.

The all-white/all-black signal generating circuit/time difference generating circuit 13 is formed by an all-white/all-black signal generating circuit and a time difference generating circuit. The all-white/all-black signal generating circuit, by taking the logical AND of all the data output in parallel from the parallel latch circuit 12, detects a condition in which all the data of the data driver circuit are output and generates an all-white detection signal, and by taking the logical NOR of all the data output in parallel from the parallel latch circuit 12, detects the condition in which no data signal is being output, and generates an all-black detection signal, and by making a comparison between the logical AND of the previous scan period and the current scan period and the logical NOR of the previous scan period and the current scan period, generates an all-white/all-black detection signal if an all-white signals and an all-black signals are detected continuously.

The latch control signal ϕ1A is output to the odd-numbered latch circuits L1, L3 and so on, and the latch control signal ϕ2A is output to the even-numbered latch circuits L2, L4, and so on. When this is done if the all-white/all-black detection signal is not generated, the latch control signals ϕ1A and ϕ2A are generated with the same timing, but if the all-white/all-black detection signal is generated, a prescribed time difference is imparted between the latch control signals ϕ1A and ϕ2A, so that the latch control signal Φ2A is delayed by a prescribed time τ relative to the latch control signal ϕ1A.

The operation of the data driver circuit of this embodiment is the same as indicated for the first embodiment shown in FIG. 1, with the exception of the generation of the latch control signals ϕ1A and ϕ2A within the all-white/all-black signal generating circuit/time difference generating circuit 13 provided in the data driver circuit.

In this case, in the time difference generating circuit, as described in the first embodiment, because the time delay to be imparted to the latch control signal ϕ2A is only approximately 100 ns, it is possible to achieve this delay time using the gate delay of the required number of series-connected inverters or the like, making it easy to impart the delay time τ between the latch control signals ϕ1A and ϕ2A.

In this manner, by adopting a configuration in which a time difference is provided between the even-numbered high-voltage data signals and the odd-numbered high-voltage data signals output from the data driver circuit in accordance with the latch control signals ϕ1A and ϕ2A output from the all-white/all-black signal generating circuit/time difference generating circuit 13 provided within the data driver circuit, it is possible to achieve a charging/discharging load by means of the capacitance between adjacent data electrodes, in response to the detection of a condition in which potentials on adjacent data electrodes change to be the same potential at the same time, thereby suppressing a sudden change in the voltage when the high-voltage data voltage is switched at the data electrodes, and reducing the accompanying switching noise that is generated.

(Third Embodiment)

Figure 5:
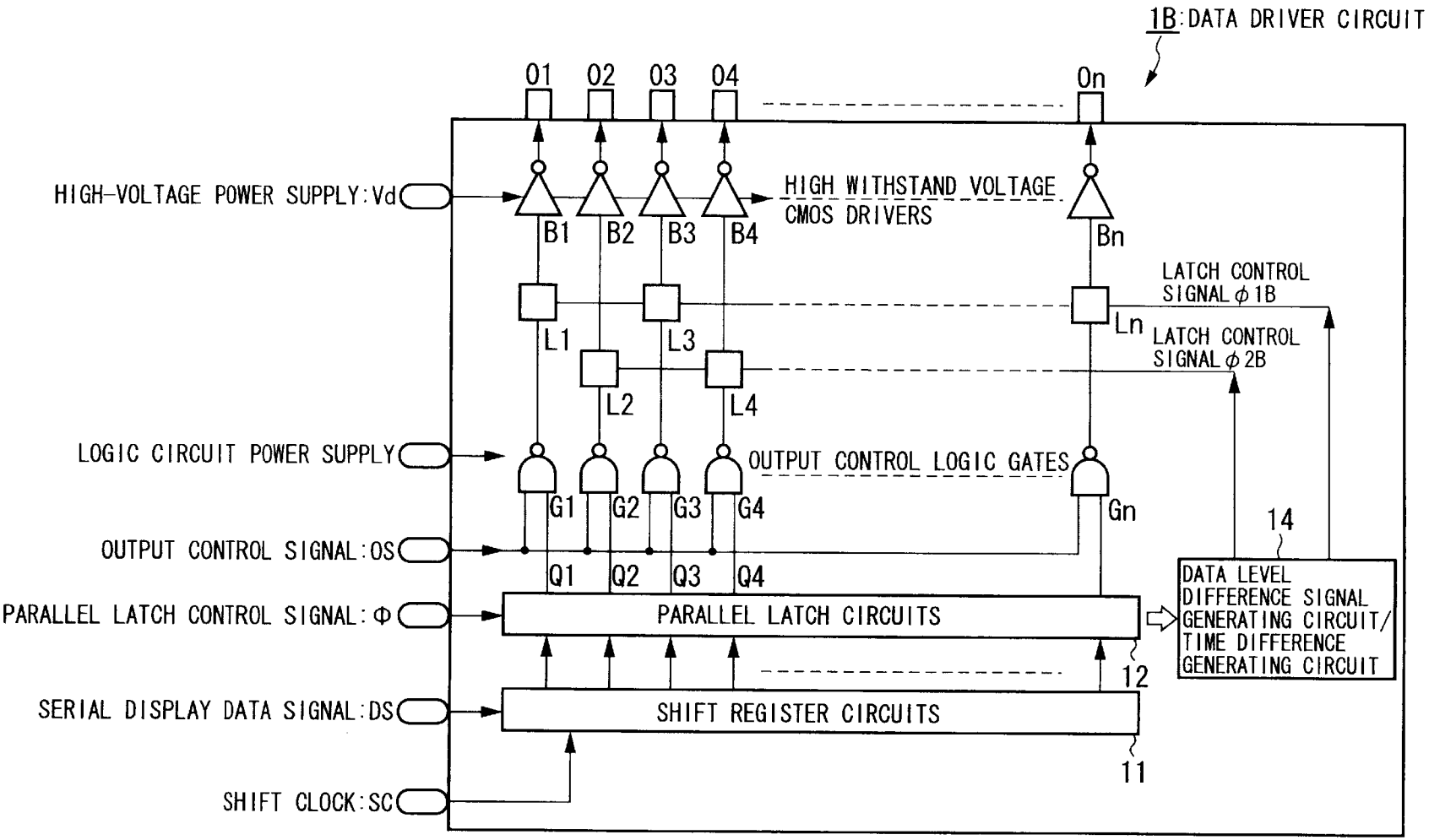
FIG. 5 is a drawing showing the configuration of a data driver circuit according to a third embodiment of the present invention.
Figure 6:
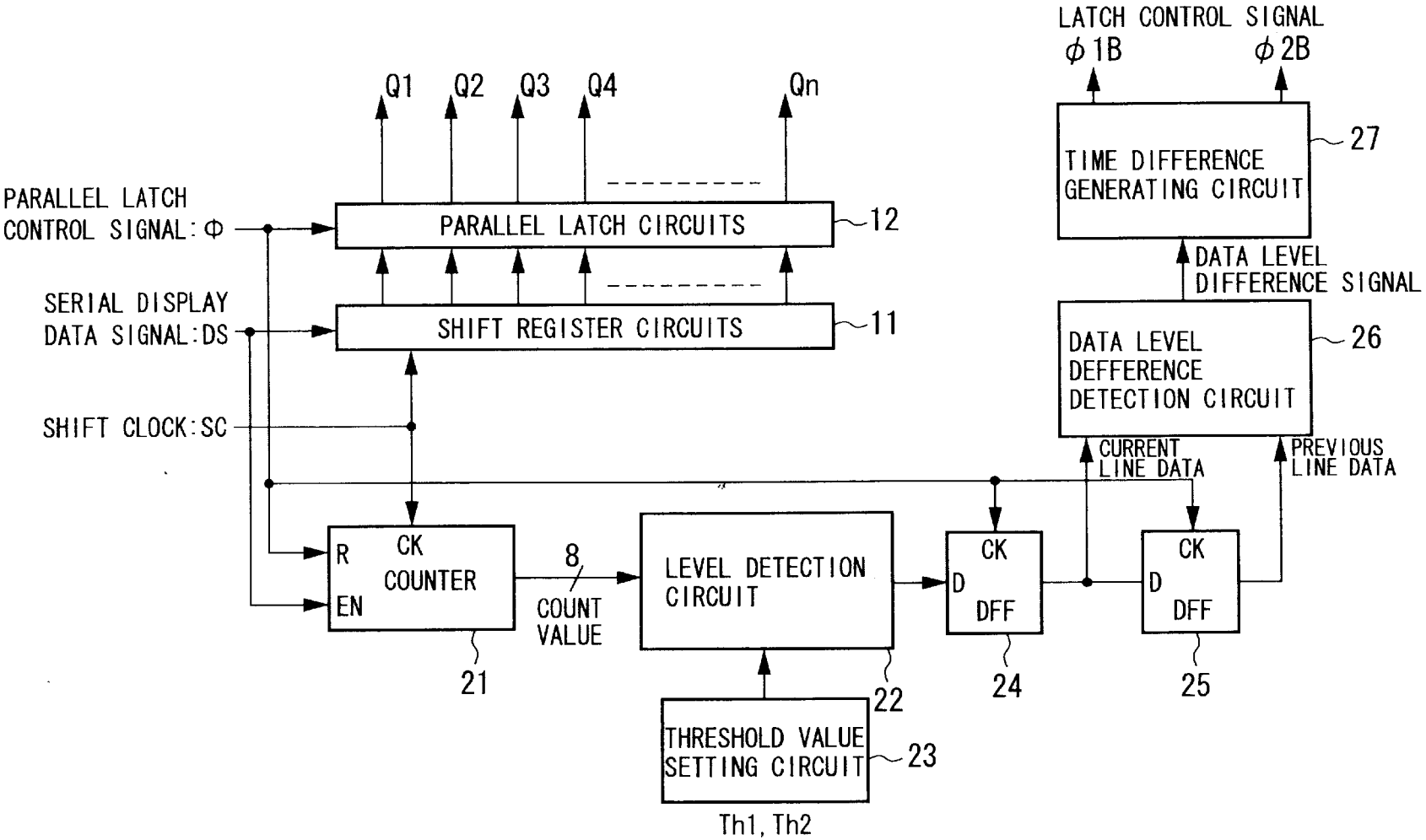
FIG. 6 is a block diagram showing the configuration of data level difference signal generator circuit and time difference generator circuit shown in FIG. 5.
Figure 7:
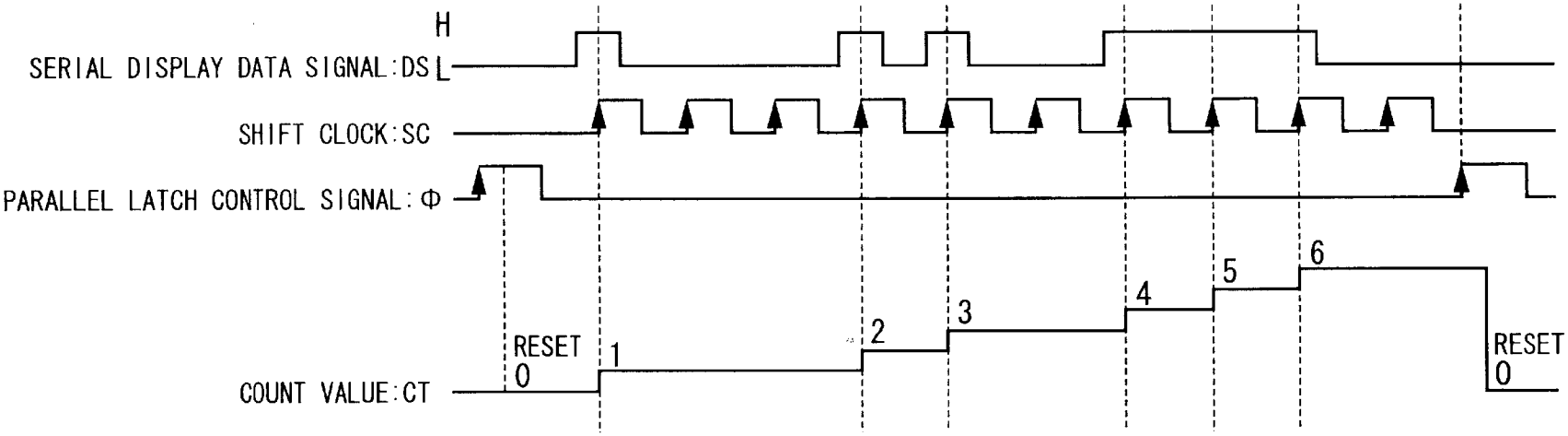
FIG. 7 is a timing diagram illustrating the operation of the data level difference generator circuit and timing difference generator circuit.

FIG. 5 is a drawing showing the configuration of a data driver circuit according to a third embodiment of the present invention, FIG. 6 is a drawing showing an example of the configuration of data level difference signal generator circuit and time difference generator circuit, and FIG. 7 is a timing diagram illustrating the operation of the data level difference generator circuit and timing difference generator circuit.

As shown in FIG. 5, this data driver circuit 1B is generally formed by an n-stage shift register circuit 11, n parallel latch circuits 12, n output control logic gate circuits G1, G2, G3, G4, . . . , and Gn, n latch circuits L1, L2, L3, L4, . . . , and Ln, n high withstand voltage CMOS drivers B1, B2, B3, B4, . . . , and Bn, and a data level difference signal generating circuit/time difference generating circuit 14.

Of the above-noted elements, because the shift register circuit 11, the parallel latch circuits 12, the output control logic gate circuits G1, G2, G3, G4, . . . , and Gn, and the high withstand voltage CMOS drivers B1, B2, B3, B4, . . . , Bn are similar to the case of the prior art, shown in FIG. 9, they will not be described in detail herein.

In this embodiment, the configuration and function of the latch circuits L1, L2, L3, L4, . . . , and Ln are similar to the first embodiment illustrated in FIG. 1, with the difference being that latch control signals ϕ1B and ϕ2B, rather than being applied from outside, are applied from a data level difference signal generating circuit/time difference generating circuit 14 provided within the data driver circuit 1B.

The data level difference signal generating circuit/time difference generating circuit 14 is formed by a data level difference generating circuit and a time difference generating circuit. In the data level difference signal generating circuit, when the number of high-level data among all the data output in parallel from the parallel latch circuit 12 is greater than a first threshold value Th1, the data level signal generating circuit outputs a white priority signal, and when the number of data thereamong is below a second threshold value Th2 (where Th1>Th2), the data level signal generating circuit outputs a black priority signal, a comparison being made of the white priority signal and the black priority signal for the previous scan period and current scan period in response to the parallel latch control signal Φ, and if the black priority signal and white priority signal are detected continuously, the data level difference signal is output.

The time difference generating circuit outputs a latch control signal Φ1B for the odd-numbered latch circuits L1, L3, and so on, and outputs a latch control signal ϕ2B for the even-numbered latch circuits L2, L4, and so on, and when this is done, when the data level difference signal is not generated the latch control signals ϕ1B and ϕ2B are output at the same timing. However, if the level difference signal is generated, a prescribed time difference is imparted between the latch control signals ϕ1B and ϕ2B, so that the latch control signal ϕ2B is delayed by a prescribed time τ relative to the latch control signal ϕ1B.

In this embodiment, the data level difference signal generating circuit/time difference generating circuit 14 is formed, as shown in FIG. 6, by a counter 21, a level detection circuit 22, a threshold setting circuit 23, D-type flip-flops 24 and 25, a data level difference detection circuit 26, and a time difference generating circuit 27.

The counter 21 counts the high-level data in the serial display data signal DS at the rising edge of the shift clock signal SC. The counter 21 is reset by the parallel latch control signal Φ. The level detection circuit 22 compares the count value of the counter 21 with the first threshold value Th1 and the second threshold value Th2 set by the threshold value setting circuit 23, and generates a white priority or black priority signal in accordance comparison results.

The D-type flip-flops 24 and 25, in response to the parallel latch control signal Φ, shift and store the white priority signal data or black priority signal data output from the level detection circuit 22. If the data level difference detection circuit 26 detects continuous white priority signals or black priority signals at the output of the D-type flip-flops 24 and 25, the data level difference detection circuit 26 outputs a data level difference signal. In response to the data level difference signal output from the data level difference signal detection circuit 26, the time difference generating circuit 27 generates the latch control signals ϕ1B and ϕ2B with the above-noted time difference τ therebetween.

The operation of counting the number of the high-level data in the data level difference signal generating circuit/time difference generating circuit 14 is described below, with reference made to FIG. 7.

The counter 21, as it is reset by the parallel latch control signal Φ, counts up the number of high-level serial display data signals DS for one scan period, at the rising edge of the shift clock SC, so as to generate a count value CT.

The operation of the data driver circuit of this embodiment is the same as that of the first embodiment, with the exception of the generation of the latch control signals ϕ1B and ϕ2B within the data level difference signal generating circuit/time difference generating circuit 14 of the data driver circuit.

In this case, because the method of imparting the time difference τ to the latch control signals ϕ1B and ϕ2B in the time difference generating circuit is the same as described for the second embodiment, it will not be described in detail herein.

In this manner, by adopting a configuration in which a time difference is provided between the even-numbered high-voltage data signals and the odd-numbered high-voltage data signals output from the data driver circuit in accordance with the latch control signals ϕ1B and ϕ2B output from the data level difference signal generating circuit/time difference generating circuit 14 provided within the data driver circuit, it is possible to achieve a charging/discharging load by means of the capacitance between adjacent data electrodes, in response to the detection of a condition in which potentials on adjacent data electrodes change to be the same potential at the same time, thereby suppressing a sudden change in the voltage when the high-voltage data voltage is switched at the data electrodes, and reducing the accompanying switching noise that is generated.

In the case of this embodiment, the frequency at which potentials change to be the same potential at the same time on adjacent electrodes is detected by comparing threshold values and a charging/discharging load is achieved, so that, compared with the second embodiment, it is possible to increase the opportunities to suppress a sudden change in the voltage waveform at the time of switching of the high voltage at data electrodes.

(Fourth Embodiment)

Figure 8:
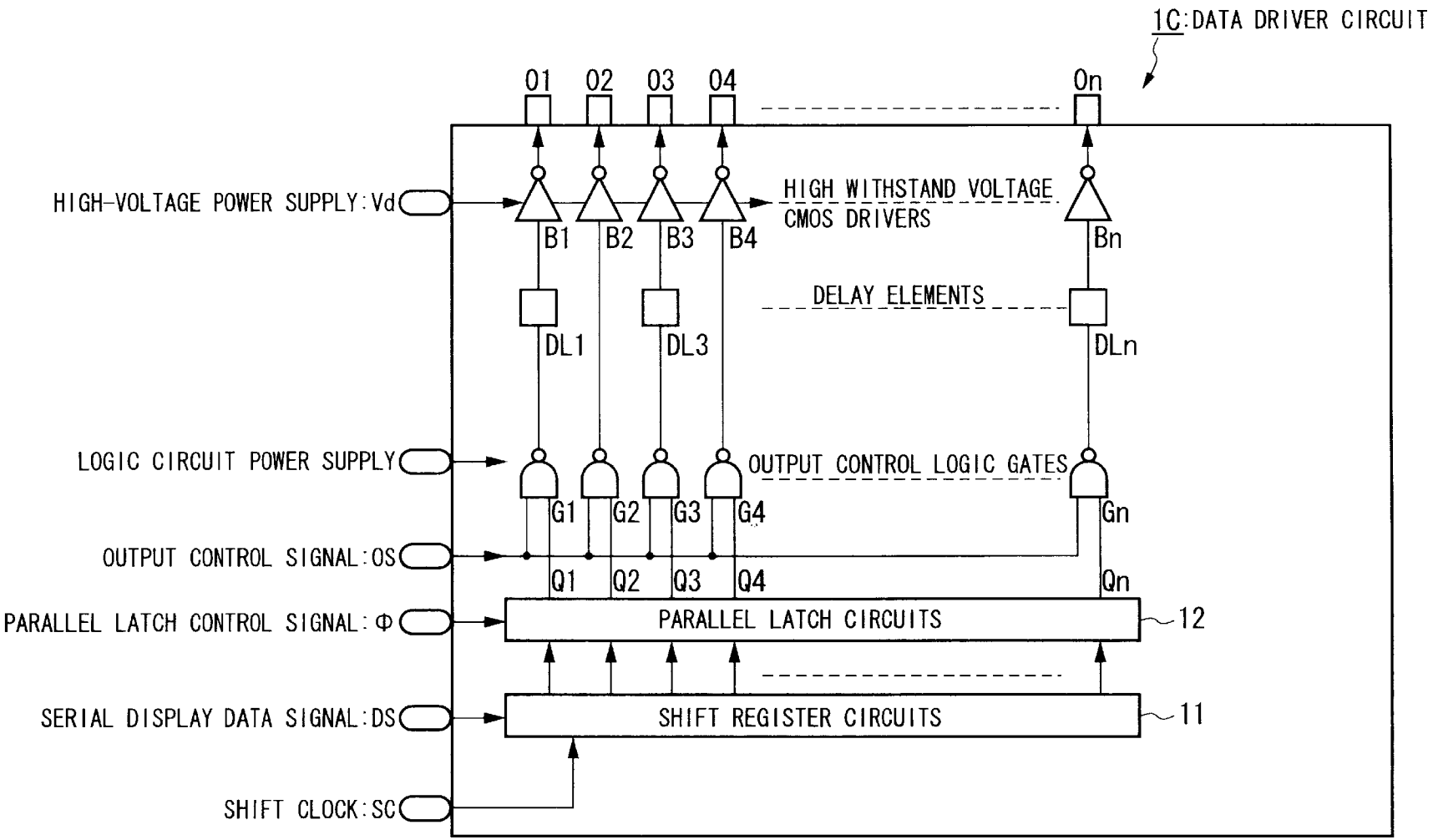
FIG. 8 is a drawing showing the configuration of a data driver circuit according to a fourth embodiment of the present invention.

FIG. 8 shows the configuration of a data driver circuit according to a fourth embodiment of the present invention.

As shown in FIG. 8, this data driver circuit 1C is formed by an n-stage shift register circuit 11, n parallel latch circuits 12, n output control logic gate circuits G1, G2, G3, G4, . . . , and Gn, n high withstand voltage CMOS drivers B1, B2, B3, B4, . . . , and Bn and alternately skipped delay elements DL1, DL3, and so on disposed between odd-numbered output control logic gate circuits G1, G3, and so on, and corresponding odd-numbered high withstand voltage CMOS drivers B1, B3, and so on.

Of the above-noted elements, because the shift register circuit 11, the parallel latch circuits 12, the output control logic gate circuits G1, G2, G3, G4, . . . , and Gn, and the high withstand voltage CMOS drivers B1, B2, B3, B4, . . . , Bn are similar to the case of the prior art, shown in FIG. 9, they will not be described in detail herein.

The delay elements DL1, DL3, and so on in this embodiment cause a delay of a prescribed time τ in the output signal from the output control logic gate circuits G1, G3, and so on relative to the outputs from the output control logic gate circuits G2, G4, and so on.

In the data driver circuit of this embodiment, by providing the delay elements DL1, DL3, and so on, the data output signals O1, O3, and so on from the odd-numbered high-voltage CMOS drivers B1, B3, and so on are delayed by a prescribed time τ relative to the output signals O2, O4, and so on from the even-numbered high-voltage CMOS drivers B2, B4, and so on.

Therefore, even if the data signal voltages are relatively the same, because there is a time difference of τ between the odd-numbered data signals O1, O3, and so on and the even-numbered data signals O2, O4, and so on, in the case in which, during the even-numbered data signals O2, O4, . . . , are outputting, the odd-numbered data signals O1, O3, . . . , do not output, so that it is possible to achieve a charging/discharging load by means of inter-electrode capacitances C1 and C2 between adjacent data electrodes at the time of switching of high-voltage data, thereby suppressing a sudden change in the switching voltage waveform and reducing the occurrence of noise.

In this case, because the delay time τ in which the data signals O1, O3, and so on from the odd-numbered high withstand CMOS drivers B1, B3 and so on delay by virtue of the delay elements DL1, DL3, and so on, is only approximately 100 ns, as described in the first embodiment, it is possible to achieve this delay time using the gate delay of the required number of series-connected inverters or the like.

In this manner, by adopting a data driver circuit having a configuration in which a time difference is provided between the even-numbered high-voltage data signals and the odd-numbered high-voltage data signals by using delay elements DL1, DL3, and so on, regardless of whether or not there the change in voltage at adjacent data electrodes, it is possible to achieve a charging/discharging load by means of the capacitance between adjacent data electrodes, thereby enabling suppression of a sudden change in voltage waveform and accompanying switching noise when data electrode high-voltage data is switched, using a simple circuit configuration.

The present invention is described above in the form of embodiments, and it will be understood that the present invention is not restricted to the foregoing embodiments, and can be embodied in other variations, within the technical scope of the present invention. For example, the plasma display panel to which the data driver circuit of the present invention is not restricted to an AC drive type, and can alternatively be a DC drive type plasma display panel. Furthermore, the display is not restricted to a color plasma display panel, and can alternatively be a monochrome plasma display panel. It should also be understood that it is not required that the plasma display panel be a sub-field drive type plasma display panel.

In the foregoing first embodiment, second embodiment, and third embodiment, because it is sufficient that the gate circuits L1, L2, L3, L4, and so on be capable of imparting a prescribed time difference between output signals from the even-numbered gates and the odd-numbered gates, it is possible to delay the output signals from the output control logic gate circuits at the odd-numbered gate circuits L1, L3, and so on, and also possible to omit the odd-numbered gate circuits L1, L3, and so on. In the third embodiment it is possible in the data level difference signal generating circuit/time difference generating circuit 14, to set the threshold values not by the threshold value setting circuit 23, but by supplying various threshold level signals from the outside.

A data driver circuit according to the foregoing embodiments is suitable for implementation as an integrated circuit, and by providing a plurality of data driver circuits within a plasma display panel device, and controlling the time difference of data signal outputs at adjacent data electrodes for each data driver circuit separately, it is possible to perform control in small circuit units, thereby greatly improving the effectiveness in reducing noise.

According to a data driver circuit of the present invention configured as described in detail above, by dividing data electrodes to which data signals are supplied from the data driver circuit into even-numbered and odd-numbered electrodes, detecting a condition in which the potentials on adjacent electrodes change to be the same potential at the same time, and imparting a time difference between the data signals output from odd-numbered data electrodes and the data signals output from even-numbered data electrodes, it is possible to easily achieve a charging/discharging load for the inter-electrode capacitance, thereby suppressing a sudden change in the voltage waveform when the high-voltage data signals at data electrodes are switched and reducing the associated switching noise.

What is claimed is:

1. A data driver circuit for a plasma display device having a first data electrode and a second electrode that are disposed adjacently to each other, said data driver circuit comprising:

a first circuit means for outputting first display data to said first data electrode;

a second circuit means for outputting second display data to said second data electrode; and an output timing control means for controlling a timing of outputting said first display data from said first circuit means to said first data electrode or a timing of outputting said second display data from said second circuit means to said second data electrode.

2. A data driver circuit for a plasma display device having a first data electrode and a second electrode that are disposed adjacently to each other, said data driver circuit comprising:

a first latch circuit for latching first display data for outputting to said first data electrode;

a second latch circuit for latching second display data for outputting to said second data electrode;

a first latch signal for said first latch circuit;

a second latch signal for said second latch circuit; and a latch timing control means for controlling a latch timing of said first display data by said first latch signal or a latch timing of said second display data by said second latch signal;

wherein said latch timing of said second latch circuit is different from that of said first latch circuit.

3. The data driver circuit according to claim 2, wherein said data driver circuit further comprising:

a time difference generating means for controlling said latch timing control means in accordance with said first display data and said second display data;

wherein said time difference generating means generates a time difference between said latch timing of said first latch circuit and said latch timing of said second latch circuit.

4. A data driver circuit for a plasma display device having a first data electrode and a second electrode that are disposed adjacently to each other, said data driver circuit comprising:

a first circuit means for outputting first display data to said first data electrode at a first timing;

a second circuit means for outputting second display data to said second data electrode at said first timing or a second timing that is different from said first timing; and an output timing control means for selecting either said first timing or said second timing so as to control an output timing of said second circuit means.

5. A data driver circuit for a plasma display device having a first data electrode and a second electrode that are disposed adjacently to each other, said data driver circuit comprising:

a first latch circuit for latching first display data for outputting to said first data electrode;

a second latch circuit for latching second display data for outputting to said second data electrode;

a latch signal for said second latch circuit; and a latch timing control means for controlling a latch timing of said second display data by said latch signal;

wherein said latch timing of said second latch circuit is different from that of said first latch circuit.

6. The data driver circuit according to claim 5, wherein said data driver circuit further comprising:

a time difference generating means for controlling said latch timing control means in accordance with said first display data and said second display data;

wherein said time difference generating means generates a time difference between said latch timing of said first latch circuit and said latch timing of said second latch circuit.

7. A data driver circuit for a plasma display device having a first data electrode and a second electrode that are disposed adjacently to each other, said data driver circuit comprising:

a first latch circuit for latching first display data for outputting to said first data electrode;

a second latch circuit for latching second display data for outputting to said second data electrode;

a first latch signal for said first latch circuit; and a second latch signal, a latch timing of which being different from that of said first latch circuit, for said second latch circuit.

8. A data driver circuit for a plasma display device having a first data electrode and a second electrode that are disposed adjacently to each other, said data driver circuit comprising:

a first circuit means for outputting first display data to said first data electrode;

a second circuit means for outputting second display data to said second data electrode; and a delay means provided in said second circuit means so as to delay an output timing of said second display data with respect to that of said first display data.

* * * * *